US007967698B2

(12) United States Patent
Kato

(10) Patent No.: US 7,967,698 B2
(45) Date of Patent: Jun. 28, 2011

(54) SHAFT FOR GOLF CLUB

(75) Inventor: Masatoshi Kato, Kobe (JP)

(73) Assignee: SRI Sports Limited, Kobe (JP)

( * ) Notice: Subject to any disclaimer, the term of this patent is extended or adjusted under 35 U.S.C. 154(b) by 157 days.

(21) Appl. No.: 12/348,407

(22) Filed: Jan. 5, 2009

(65) Prior Publication Data

US 2009/0264216 A1 Oct. 22, 2009

(30) Foreign Application Priority Data

Apr. 17, 2008 (JP) ..... 2008-107371

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 6,306,047 B1 * 10/2001 Kusumoto ..... 473/319
2007/0117647 A1 * 5/2007 Nakajima ..... 473/316

FOREIGN PATENT DOCUMENTS

JP 9-234256 A 9/1997
JP 2002-126141 A 5/2002
JP 2002126141 A * 5/2002
JP 2002137285 A * 5/2002
JP 2003052875 A * 2/2003

* cited by examiner

*Primary Examiner* — Stephen L. Blau
(74) *Attorney, Agent, or Firm* — Birch, Stewart, Kolasch & Birch, LLP

(57) ABSTRACT

A shaft according to the present invention is obtained by winding and curing a prepreg sheet having a matrix resin and a fiber. The prepreg sheet includes a full-length sheet and a partial sheet. At least a part of the partial sheet forms a tip bias layer disposed in a tip portion of the shaft. A fiber of the first tip bias layer is oriented at an angle which is equal to or greater than 25 degrees and is equal to or smaller than 65 degrees with respect to an axis of the shaft. A fiber of the second tip bias layer is oriented at an angle which is equal to or greater than −65 degrees and is equal to or smaller than −25 degrees with respect to the axis of the shaft. The shaft is obtained by winding a tip bias stuck body (V1) fabricated by sticking a first tip bias sheet (a8) and a second tip bias sheet (a9) together.

6 Claims, 13 Drawing Sheets

SHAFT FOR GOLF CLUB

This application claims priority on Patent Application No. 2008-107371 filed in JAPAN on Apr. 17, 2008, the entire contents of which are hereby incorporated by reference.

BACKGROUND OF THE INVENTION

1. Field of the Invention

The present invention relates to a shaft for a golf club.

2. Description of the Related Art

So-called steel and carbon shafts have been known as a shaft for a golf club. A material of the carbon shaft is a CFRP (a carbon fiber reinforced plastic).

Many carbon shafts are manufactured by a so-called sheet winding process. In the sheet winding process, a prepreg sheet having a fiber and a matrix resin is used. In the process, a sheet constituted by the prepreg is wound around a metallic core body and the matrix resin is then cured by heating, and the core body is pulled out after the curing. By the process, a shaft is formed by winding and curing the prepreg sheet.

The carbon shaft usually has a straight layer and a bias layer (an angle layer). The bias layer is mainly related to a twist rigidity of the shaft. A shaft torque value (which is also referred to as a torque value) has been known as an index representing the twist rigidity of the shaft. A twist angle formed by an application of a torque on a constant condition is the torque value. The lower torque value means the higher twist rigidity of the shaft.

A high twist rigidity can suppress the twist of the shaft which is caused by a shock power of an impact. The high twist rigidity can improve a orientation of a ball.

An increase in an amount of a fiber of the bias layer can contribute to enhance the twist rigidity. On the other hand, a weight of the shaft is increased. The increase in the weight of the shaft causes a decrease in a head speed and a reduction in a flight distance. By an increase in a coefficient of elasticity of a fiber in the bias layer, similarly, it is possible to enhance the twist rigidity. In this case, however, a strength of the shaft tends to be reduced.

Japanese Laid-Open Patent Publication No. 9-234256 has disclosed a shaft in which a partial bias layer is provided in tip and butt end portions in addition to a bias layer provided over a full length of the shaft. Japanese Laid-Open Patent Publication No. 2002-126141 has disclosed a shaft in which a stuck sheet laminated and integrated by sticking two bias sheets is laminated on an outer layer.

SUMMARY OF THE INVENTION

As a result of investigations made by the inventor, it was found that a provision of a partial bias layer (a tip bias layer) in a tip portion of a shaft is effective for enhancing a twist rigidity of the shaft while suppressing an increase in a weight of the shaft. However, it was proved that a physical property value of the shaft, for example, a shaft torque value tends to be varied in the case in which the tip bias layer is provided.

It is an object of the present invention to provide a shaft for a golf club which can suppress a variation in a physical property of the shaft having a tip bias layer in the same shaft.

The shaft for a golf club according to the present invention is obtained by winding and curing a prepreg sheet having a matrix resin and a fiber. The prepreg sheet includes a full-length sheet provided wholly in an axial direction of the shaft and a partial sheet provided in a part in the axial direction of the shaft. At least a part of the partial sheet forms a tip bias layer disposed in a tip portion of the shaft. The tip bias layer has a first tip bias layer and a second tip bias layer. A fiber of the first tip bias layer is oriented at an angle which is equal to or greater than −65 degrees and is equal to or smaller than −25 degrees with respect to an axis of the shaft. A fiber of the second tip bias layer is oriented at an angle which is equal to or greater than 25 degrees and is equal to or smaller than 65 degrees with respect to the axis of the shaft. The shaft is obtained by winding a tip bias stuck body having a first tip bias sheet to be a sheet for the first tip bias layer and a second tip bias sheet to be a sheet for the second tip bias layer which are stuck together.

It is preferable that when an end on a winding start side of the first tip bias layer is represented by T1 and an end on a winding start side of the second tip bias layer is represented by T2, an angle difference θ between a position in a circumferential direction of the end T1 and a position in the circumferential direction of the end T2 should be equal to or smaller than 90 degrees.

It is preferable that a stuck body fabricated by sticking a first sheet for the first tip bias sheet and a second sheet for the second tip bias sheet together should be cut so that the first tip bias sheet and the second tip bias sheet should be formed and the tip bias stuck body should be simultaneously formed.

It is preferable that the partial sheet should include a tip bias protective layer disposed in the tip portion of the shaft. It is preferable that the tip bias protective layer should cover the whole tip bias layer.

A method of manufacturing a shaft according to the present invention includes the steps of cutting a prepreg sheet having a matrix resin and a fiber, thereby fabricating a full-length sheet provided wholly in an axial direction of the shaft and a partial sheet provided in a part in the axial direction of the shaft, sticking sheets for bias layers together, winding the cut sheet around a mandrel to obtain a wound body, curing the matrix resin of the wound body to obtain a cured and laminated body, and polishing a surface of the cured and laminated body. In the manufacturing method, the partial sheet includes a first tip bias sheet for orientating a fiber at an angle which is equal to or greater than −65 degrees and is equal to or smaller than −25 degrees with respect to an axis of the shaft and a second tip bias sheet for orienting a fiber at an angle which is equal to or greater than 25 degrees and is equal to or smaller than 65 degrees with respect to the axis of the shaft. The sticking step and/or the cutting step include(s) a step of obtaining a tip bias stuck body having the first tip bias sheet and the second tip bias sheet stuck together. The winding step includes a step of winding the tip bias stuck body.

The present invention can suppress a partial disappearance (lack) of the tip bias layer and a winding failure. According to the present invention, therefore, it is possible to suppress a variation in the physical property value of the shaft.

DESCRIPTION OF THE PREFERRED EMBODIMENTS

The present invention will be described below in detail based on preferred embodiments with reference to the drawings.

With reference to the drawings, the present invention will be described below in detail based on the preferred embodiments. In the present application, "an axial direction of a shaft" indicates a direction of a central axis of the shaft and is coincident with a longitudinal direction of the shaft. In the present application, the "axial direction of a shaft" will also be referred to as an "axial direction". In the present application, moreover, a prepreg sheet will also be referred to as a sheet.

Figure 1:
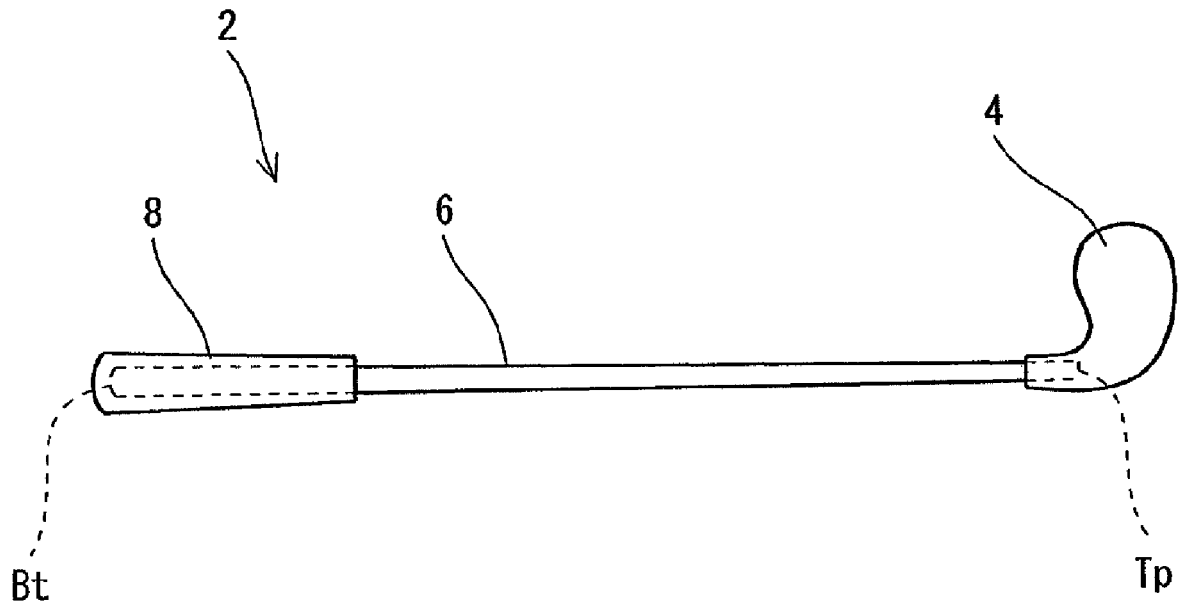
FIG. 1 is a general view showing a golf club to which a shaft according to an embodiment of the present invention is attached.

As shown in FIG. 1, a golf club 2 has a head 4, a shaft 6 and a grip 8. The head 4 is attached to one of ends of the shaft 6. The grip 8 is attached to the other end of the shaft 6.

The head 4 and the grip 8 which are to be attached to the shaft 6 are not restricted. Examples of the head 4 include a golf club head of a wood type, a golf club head of an iron type, a patter head and the like.

The shaft 6 is a tubular body. The shaft 6 has a tip end Tp and a butt end Bt. The head 4 is attached to the tip end Tp. The grip 8 is attached to the butt end Bt. In the golf club 2, the tip end Tp is positioned in an inner part of a shaft hole of the head 4. In the golf club 2, the butt end Bt is positioned in an inner part of a shaft inserting hole of the grip 8.

The shaft 6 is a so-called carbon shaft. The shaft 6 is obtained by curing a prepreg sheet. In the prepreg sheet, a fiber is oriented substantially in a single direction. The prepreg in which a fiber is thus oriented substantially in a single direction is also referred to as a UD prepreg. "UD" stands for a unidirection. The UD prepreg is preferably used for a tip bias sheet according to the present invention. The prepreg sheet has a fiber and a matrix resin. Typically, the fiber is a carbon fiber. Typically, the matrix resin is a thermosetting resin.

The shaft 6 is manufactured by a so-called sheet winding process. In a state of the prepreg, the matrix resin is set in a semicuring state. The shaft 6 is obtained by winding and curing the prepreg sheet. The curing implies that the matrix resin set in the semicuring state is to be cured. The curing is achieved by heating. A process for manufacturing the shaft 6 includes a heating step. At the heating step, the matrix resin of the prepreg sheet is cured.

Figure 2:
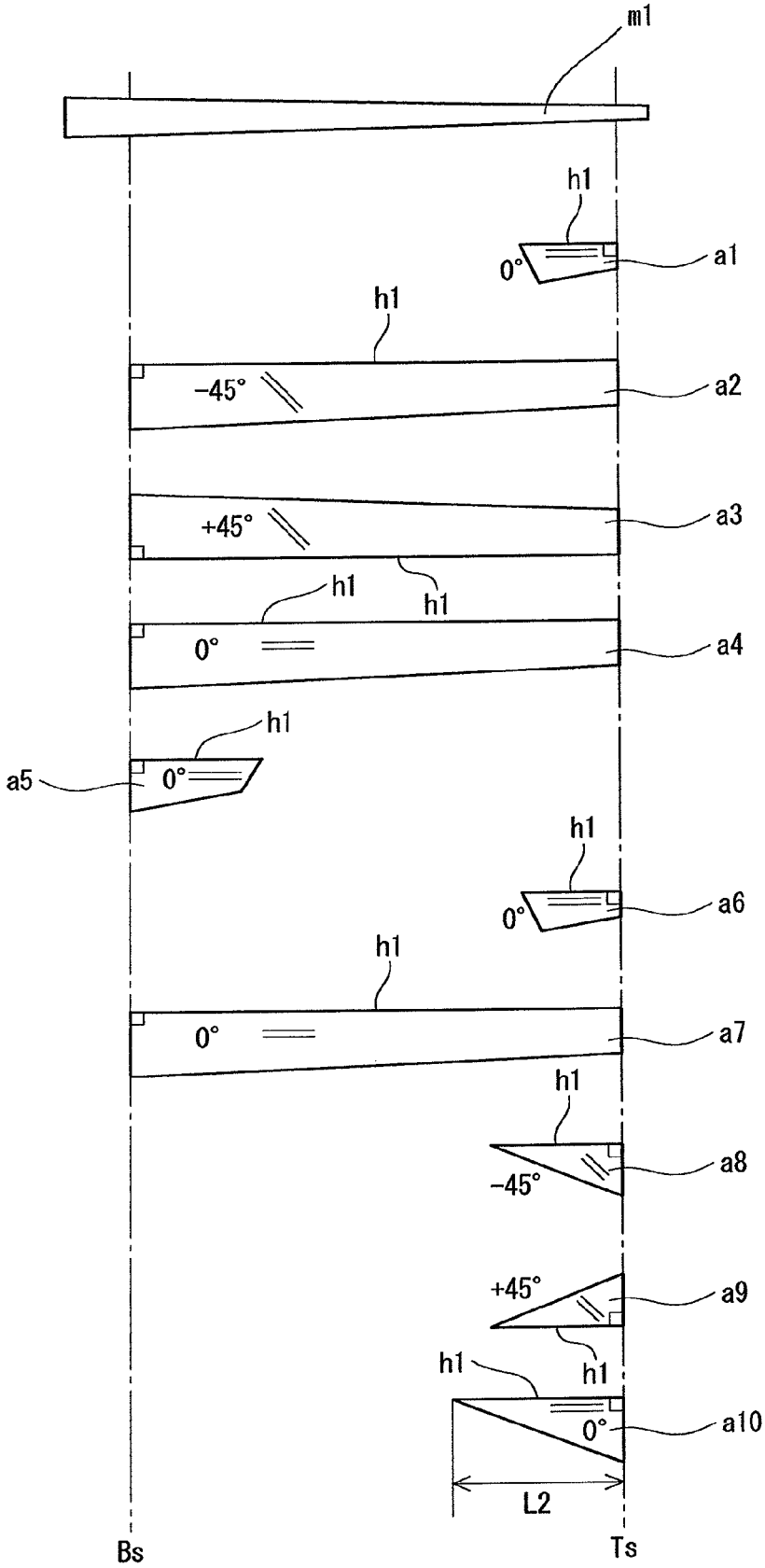
FIG. 2 is a developed view showing the shaft (a view showing a structure of a sheet) according to the embodiment of the present invention.

FIG. 2 is a developed view showing the prepreg sheet constituting the shaft 6 (a view showing a structure of the sheet). The shaft 6 is constituted by a plurality of sheets. More specifically, the shaft 6 is constituted by ten sheets of a1 to a10. In the present application, the developed views of FIG. 2 and the like show the sheets constituting the shaft in order from an inside in a radial direction of the shaft. The sheets positioned on an upper side in the developed views are wound around a mandrel m1 in order. In the developed views of FIG. 2 and the like, a transverse direction in the drawings is coincident with the axial direction of the shaft. In the developed views of FIG. 2 and the like, a right side in the drawings is set to be the tip end Tp side of the shaft. In the developed views of FIG. 2 and the like, a left side in the drawings is set to be the butt end Bt side of the shaft. FIG. 2 also shows the mandrel m1. The mandrel m1 is finally pulled out. The mandrel m1 forms a hollow portion (an internal surface) of the shaft 6.

In FIG. 2, positions of a tip end Ts and a butt end Bs in a wound body are shown. In a manufacture of the shaft 6, both ends of the wound body obtained after the curing are usually cut. The both ends thus cut serve as the tip end Tp and the butt end Bt in the shaft 6. In this case, therefore, the tip end Ts of the wound body and the tip end Tp of the shaft 6 are not strictly coincident with each other, and the butt end Bs of the wound body and the butt end Bt of the shaft 6 are not strictly coincident with each other.

The developed views of FIG. 2 and the like also show an arrangement of each sheet in the axial direction of the shaft in addition to a winding order of each sheet. For example, one of ends of the sheet a1 is positioned on the tip end Ts. For example, the other end of the sheet a5 is positioned on the butt end Bs. One of ends of each of the tip bias sheets a8 and a9 is positioned on the tip end Ts.

The shaft 6 has a straight layer and a bias layer. In the developed views of FIG. 2 and the like, an orientation angle of a fiber is described. A sheet having "0°" described thereon constitutes the straight layer. The sheet for the straight layer will also be referred to as a straight sheet in the present application. Sheets having "−45°" and "+45°" described thereon constitute the bias layer. The sheet for the bias layer will also be referred to as a bias sheet in the present application.

In the straight layer, an orientation of the fiber is substantially parallel with the axial direction of the shaft. Usually, the orientation of the fiber is not perfectly parallel with the axial direction of the shaft due to an error made in the winding operation or the like. In the straight layer, an angle Af formed by the orientation of the fiber and the axial direction of the shaft is equal to or greater than approximately −10 degrees and is equal to or smaller than approximately +10 degrees. In the shaft 6, the straight sheet includes the sheets a1, a4, a5, a6, a7 and a10. The straight layer has a high correlation with a bending rigidity and a bending strength in the shaft.

The bias layer is provided to increase a twist rigidity and a twist strength in the shaft. The bias layer is constituted by at least two sheets in which the orientations of the fiber are tilted in opposite directions to each other. The bias layer includes a layer having the angle Af which is equal to or greater than −65 degrees and is equal to or smaller than −25 degrees and a layer having the angle Af which is equal to or greater than 25 degrees and is equal to or smaller than 65 degrees. In the shaft 6, the sheet constituting the bias layer includes the sheets a2, a3, a8 and a9. Signs of plus (+) and minus (−) in the angle Af indicate that the fibers of the bias sheets to be stuck together are tilted in opposite directions to each other.

Although the sheet a2 has an angle Af of −45 degrees and the sheet a3 has an angle Af of +45 degrees in the embodiment shown in FIG. 2, it is a matter of course that the sheet a2 may have the angle Af of +45 degrees and the sheet a3 may have the angle Af of −45 degrees. Although the sheet a8 has an angle Af of −45 degrees and the sheet a9 has an angle Af of +45 degrees in the embodiment shown in FIG. 2, moreover, it is a matter of course that the sheet a8 may have the angle Af of +45 degrees and the sheet a9 may have the angle Af of −45 degrees. It is sufficient that the fibers of the bias layers to be stuck together are tilted in an opposite direction to the axis of the shaft.

It is also possible to provide layers other than the straight layer and the bias layer. For example, a hoop layer may be provided. In the hoop layer, an orientation of a fiber is substantially perpendicular to the axis of the shaft. The hoop layer is provided to increase a crushing rigidity and a crushing strength in the shaft. The crushing rigidity implies a rigidity against a force for crushing the shaft inward in the radial direction. The crushing strength implies a strength against the force for crushing the shaft inward in the radial direction. The crushing strength can also be related to the bending strength. A crushing deformation can be generated interlockingly with a bending deformation. A shaft having a small thickness and weight, particularly, the interlocking property is great. By an increase in the crushing strength, it is also possible to enhance the bending strength. In the hoop layer, the orientation of the fiber is set to be substantially perpendicular to the axial direction of the shaft. In other words, in the hoop layer, the orientation is set to be substantially parallel with a circumferential direction of the shaft. Usually, the orientation of the fiber is not perfectly perpendicular to the axial direction of the shaft due to an error made in the winding operation, or the like. In the hoop layer, the angle Af is usually 90 degrees±10 degrees. In the shaft 6 according to the present embodiment, the hoop layer is not provided.

As shown in FIG. 2, all of the sheets have a side h1 which is disposed orthogonally to at least one of the other sides in almost parallel with the axial direction of the shaft.

Description will be given to the prepreg sheets a1 to a10 to be used for manufacturing the shaft 6. The prepreg sheet which has not been used is interposed between peeling sheets, which is not shown. The peeling sheet includes a releasing paper and a resin film. The prepreg sheet which has not been used is interposed between the releasing paper and the resin film. More specifically, the releasing paper is stuck to one of surfaces of the prepreg sheet, and the resin film is stuck to the other surface of the prepreg sheet. In the following description, the surface to which the releasing paper is stuck will also be referred to as "a surface on the releasing paper side" and the surface to which the resin film is stuck will also be referred to as "a surface on the film side".

In the developed view of FIG. 2, the surface on the film side is set to be a right side. More specifically, in the developed views of FIG. 2 and the like, the right side of the drawings is set to be the surface on the film side and a back side of the drawings is set to be the surface on the releasing paper side. In a state of FIG. 2, a direction of the fiber of the sheet a2 is identical to a direction of the fiber of the sheet a3. However, the sheet a3 is turned over in sticking which will be described below so that the direction of the fiber of the sheet a2 is reverse to the direction of the fiber of the sheet a3. In consideration of this respect, in FIG. 2, the direction of the fiber of the sheet a2 is described as "−45°" and the direction of the fiber of the sheet a3 is described as "+45°". Referring to the sheets a8 and a9, similarly, the direction of the fiber of the sheet a8 is described as "−45°" and the direction of the fiber of the sheet a9 is described as "+45°". Also in the other developed views in the present application (FIGS. 8, 10 and 11), the surface on the film side is set to be a right side.

A method of winding the prepreg sheet will be described. In order to wind the prepreg sheet, the resin film is first peeled. When the resin film is peeled, the surface on the film side is exposed. The exposed surface has an adhesion (a tacking property). The adhesion is caused by the matrix resin. More specifically, since the matrix resin is set in the semicuring state, it has the adhesion. Next, an edge portion of the surface on the film side thus exposed (which will also be referred to as a winding start edge portion) is stuck to a winding object. With the adhesion of the matrix resin, the winding start edge portion can be stuck smoothly. The winding object is the mandrel m1 or a wound object obtained by winding another prepreg sheet around the mandrel m1. Next, the releasing paper is peeled. Subsequently, the winding object is rotated so that the prepreg sheet is wound around the winding object. Thus, the resin film is first peeled and the winding start end is then stuck to the winding object, and the releasing paper is thereafter peeled. Thus, the releasing paper is peeled immediately before the winding operation so that wrinkles or winding failures of the sheet are suppressed. More specifically, the wrinkles or winding failures of the sheet are suppressed by a procedure for peeling the resin film earlier, sticking the winding start edge portion to the winding object and then peeling the releasing paper. The reason is that the sheet having the releasing paper stuck thereto is supported on the releasing paper and is therefore hard to wrinkle. The releasing paper has a higher bending rigidity than the resin film.

A method of manufacturing the shaft 6 will be schematically described below. The manufacturing method includes the following steps.

(1) Cutting Step

At a cutting step, a prepreg sheet is cut to have a desirable shape. By the cutting operation, a full-length sheet and a partial sheet are fabricated. The full-length sheet is provided wholly in the axial direction of the shaft. The partial sheet is provided in a part in the axial direction of the shaft. The cutting operation may be carried out by a cutting machine or a manual operation by means of a cutter knife or the like.

(2) Sticking Step

At a sticking step, sheets for the bias layer are stuck together. The sticking step may be carried out after the cutting step or may be carried out before the cutting step as will be described below. The details of the sticking step will be described below.

(3) Winding Step

At a winding step, the cut sheet is wound around a mandrel. Through the winding step, a wound body is obtained. The wound body is obtained by winding the prepreg sheet around an outside of the mandrel. As described above, the winding step includes a step of peeling a resin film, a step of sticking a winding start edge portion of a surface on the film side to a winding object, a step of peeling a releasing paper after sticking the winding start edge portion, and a step of rotating the winding object to wind the prepreg sheet from which the resin film and the releasing paper are peeled. The winding start edge portion is set to be an edge portion of the side h1. The winding object is rotated by rolling the winding object over a flat plate. The rotation of the winding object may be carried out by a manual operation or a machine which is referred to as a rolling machine or the like.

(4) Tape Wrapping Step

At a tape wrapping step, a tape is wound around an outer peripheral surface of the wound body. The tape is also referred to as a wrapping tape. The wrapping tape is wound with an application of a tension.

(5) Curing Step

At a curing step, the wound body subjected to the tape wrapping is heated. By the heating, a matrix resin is cured. In the curing process, the matrix resin is temporarily fluidized. By the fluidization of the matrix resin, air between the sheets or in the sheet can be discharged. By the tension (fastening force) of the wrapping tape, the discharge of the air is promoted. By the curing operation, a cured and laminated body is obtained.

(6) Mandrel Pull-Out Step and Wrapping Tape Removing Step

A mandrel pull-out step and a wrapping tape removing step are carried out. Order of both of them is not restricted. In respect of an enhancement in an efficiency of the wrapping tape removing step, however, it is preferable to carry out the wrapping tape removing step after the mandrel pull-out step.

(7) Both End Cutting Step

At this step, both ends of the cured and laminated body are cut. By the cutting operation, a tip end Tp and a butt end Bt in the shaft are formed. An end face of the tip end Tp and an end face of the butt end Bt are caused to be flat through the cutting operation.

(8) Polishing Step

At this step, a surface of the cured and laminated body is polished. Spiral dents and projections left as tracks of the wrapping tape are present on the surface of the cured and laminated body. By the polishing operation, the dents and projections to be the tracks of the wrapping tape disappear and the surface is thus smoothened.

(9) Coating Step

Coating is carried out over the cured and laminated body subjected to the polishing step.

The process for manufacturing the shaft 6 has been schematically described above. Thus, the mandrel m1 is required for manufacturing the shaft 6. The mandrel m1 has a circular section. An external surface of the mandrel m1 has a taper portion. At the winding step, first of all, the sheet a1 is wound around the mandrel m1. Next, a stuck body constituted by the sheets a2 and a3 is wound around the mandrel m1 having the sheet a1 wound therearound. The mandrel m1 having the sheet a1 wound therearound is a winding object. Before the winding operation, the sheets a3 and a2 are previously stuck together so that the stuck body is formed. Then, the sheet a4 is wound. The sheets a5, a6 and a7 are wound in this order. Next, a tip bias stuck body V1 which will be described below is wound. The tip bias stuck body V1 includes the sheets a8 and a9. Finally, the sheet a10 is wound.

In the shaft 6 according to the present embodiment, a combination of the sheets which is intended for the sticking step includes a set of the sheets a2 and a3 and a set of the sheets a8 and a9. The sheets a2 and a3 are full-length sheets and bias sheets. In the present application, the sheets a2 and a3 will also be referred to as full-length bias sheets. The sheets a8 and a9 are partial sheets and bias sheets. The sheets a8 and a9 are disposed in a tip portion of the shaft. In the present application, the sheets a8 and a9 will also be referred to as tip bias sheets.

As described above, at the sticking step, the sheets a2 and a3 are stuck together so that the stuck body (not shown) is fabricated. At the sticking step, moreover, the sheets a8 and a9 are stuck together so that the tip bias stuck body V1 (see FIG. 3) is fabricated.

A step of sticking the sheets a8 and a9 will be described below. At the sticking step, first of all, the resin films of the sheets a8 and a9 are peeled. Next, the sheet a9 is turned over so that the sheets a8 and a9 are stuck to each other (see FIG. 3). The surface on the film side of the sheet a8 and the surface on the film side of the sheet a9 are stuck together. By the sticking operation, the tip bias stuck body V1 is finished. In the tip bias stuck body V1, a point p2 of the sheet a9 is disposed on the side h2 of the sheet a8 (see FIG. 3). The sticking operation is carried out in such a manner that a side h1 of the sheet a8 and a side h1 of the sheet a9 are shifted from each other. A distance of the shift is indicated as double arrows d1 and d2. More specifically, the distance of the shift between the sheets a8 and a9 is indicated as the double arrows d1 and d2 in FIG. 3. The distances d1 and d2 are distances between the side h1 of the sheet a8 and the side h1 of the sheet a9. The distance d1 is a shift distance on an end at the tip end Tp side. In other words, the distance d1 is a shift distance in the tip end Ts. The distance d2 is a shift distance on an end at the butt end Bt side. The distances d1 and d2 determine an angle difference θ which will be described below. By an adjustment of the distances d1 and d2, the angle difference θ is regulated.

Although the distances d1 and d2 may be set to be equal to each other, it is preferable that the distance d2 should be set to be greater than the distance d1. The shaft 6 is provided with such a taper as to be thinned toward the tip end Tp side. The mandrel m1 is also provided with such a taper as to be thinned toward the tip end Tp side. In order to correspond to the taper, d2>d1 is set. The reason why the d2>d1 is set is that both the side h1 of the sheet a8 and the side h1 of the sheet a9 are to be parallel with the axial direction of the shaft. In other words, the reason why the d2>d1 is set is that the angle difference θ is to be constant irrespective of a position in the axial direction of the shaft. By the design, it is possible to enhance precision in the orientation angles of the fibers of the sheets a8 and a9.

In order to set the distances d1 and d2, an outside diameter of a winding object Mt (not shown) in a stage for winding the tip bias stuck body V1 is taken into consideration. In the embodiment shown in FIG. 2, the winding object Mt is a wound body obtained by winding seven sheets, that is, the sheets a1 to a7 around the mandrel m1. The outside diameter of the winding object Mt is substantially equal to an outside diameter of an inner layer portion n1 which will be described below. In the following, the outside diameter of the winding object Mt on the end at the tip end Tp side of the tip bias stuck body V1 is represented by $\phi 1$. In the following, the outside diameter of the winding object Mt on the end at the butt end Bt side of the tip bias stuck body V1 is represented by $\phi 2$. It is preferable that $[d2/d1]=[\phi 2/\phi 1]$ should be set as a design value in order to cause the angle difference θ to be constant irrespective of the position in the axial direction of the shaft. An employment of the design value can be decided based on a mean value calculated from a plurality of products, for example.

Figure 3:
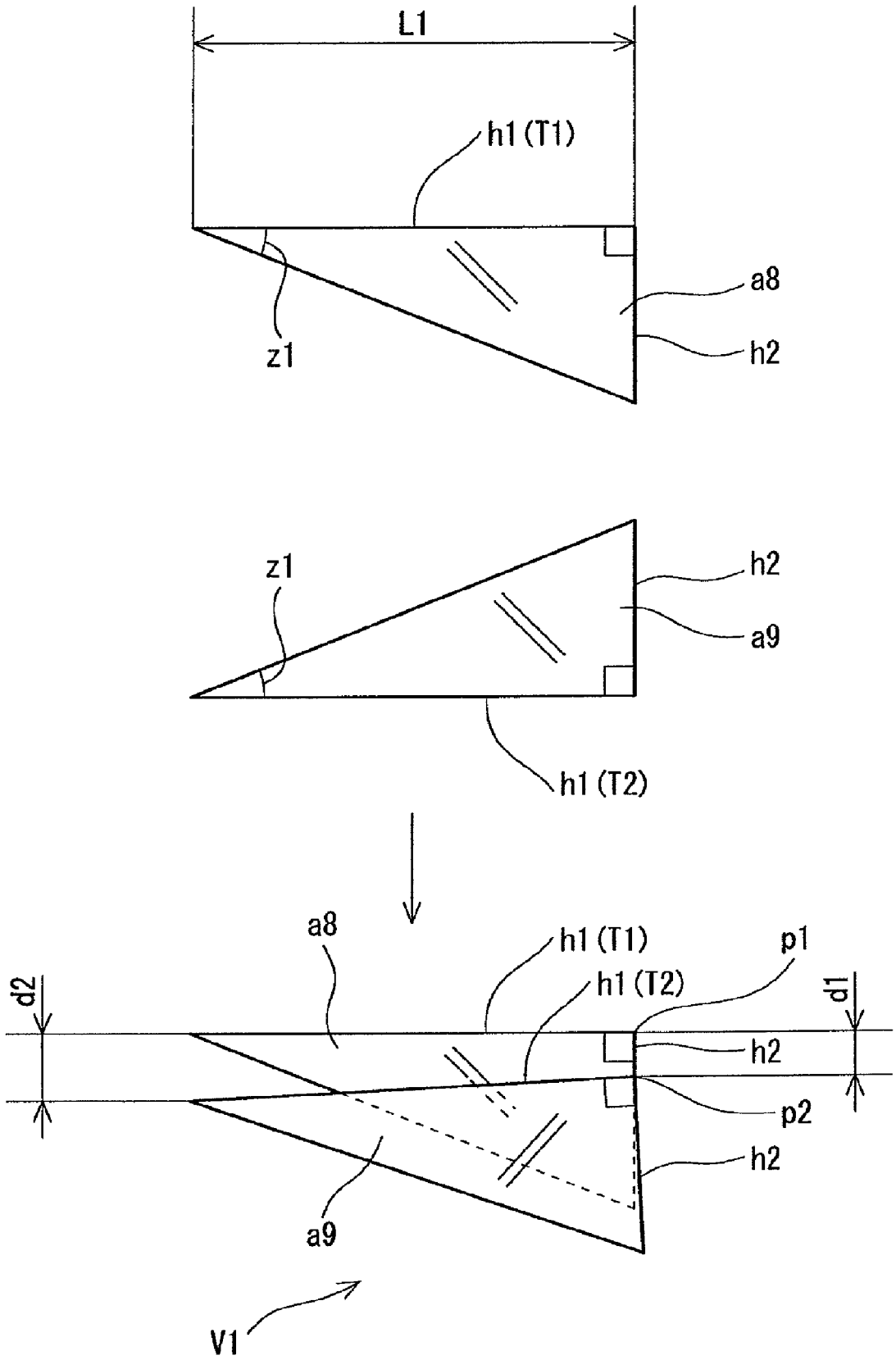
FIG. 3 is a view for explaining a step of sticking a tip bias sheet.

As described above, it is preferable that the side h1 of the sheet a8 and the side h1 of the sheet a9 should be parallel with respect to the axial direction of the shaft. In FIG. 3, points p1 and p2 are shown. The point p1 is an intersection point of the sides h1 and h2 in the sheet a8. The point p2 is an intersection point of the sides h1 and h2 in the sheet a9. When a plane including a central axis of the shaft and the point p1 is set to be a plane Hp1, it is preferable that the side h1 of the sheet a8 should be ideally disposed on the plane Hp1. In consideration of a preferable error which can be permitted, an absolute value $\alpha 1$ of an angle formed by the side h1 of the sheet a8 and the plane Hp1 is preferably equal to or smaller than five degrees, is more preferably equal to or smaller than three degrees, and is more preferably equal to or smaller than one degree. When a plane including the central axis of the shaft and the point p2 is set to be a plane Hp2, it is preferable that the side h1 of the sheet a9 should be ideally disposed on the plane Hp2. In consideration of a preferable error which can be permitted, an absolute value a2 of an angle formed by the side h1 of the sheet a9 and the plane Hp2 is preferably equal to or smaller than five degrees, is more preferably equal to or smaller than three degrees, and is more preferably equal to or smaller than one degree. In consideration of a preferable error which can be permitted, d2=d1 may be set in some cases. In these cases, the side h1 of the sheet a8 and the side h1 of the sheet a9 are set to be parallel with each other in the tip bias stuck body V1.

At the winding step, a method of winding the tip bias stuck body V1 is as follows. First of all, the releasing paper of the sheet a9 is peeled. Next, an edge portion provided along the side h1 of the sheet a8 is stuck to the winding object. More specifically, at the winding step, the edge portion of the sheet a8 serves as a winding edge portion. Subsequently, the releasing paper of the sheet a8 is peeled. Then, the tip bias stuck body V1 from which all of the releasing papers are peeled is wound around the winding object.

Although the fiber of one of the bias layers is oriented at an angle of 45 degrees with respect to the shaft axis and the fiber of the other bias layer is oriented at an angle of −45 degrees with respect to the shaft axis in the embodiment shown in FIG. 2, these angles are not restricted. As described above, the fiber of one of the bias layers can be oriented within a range which is equal to or greater than 25 degrees and is equal to or smaller than 65 degrees with respect to the shaft axis. Moreover, the fiber of the other bias layer can be oriented within a range which is equal to or greater than −65 degrees and is equal to or smaller than −25 degrees with respect to the shaft axis.

In the present application, "stick" is substantially synonymous with "superpose". Since the matrix resin of the prepreg sheet is set in the semicuring state, it has an adhesion more or less. When the prepregs are superposed through the adhesion, they are stuck together. For this reason, the superposition of the prepreg sheets is referred to as "stick".

The present inventor found that a variation in a physical property value of a shaft having a tip bias layer tends to be generated. The present inventor found a cause of the variation. The present inventor acquired a knowledge that a first cause of the variation is a disappearance of a part of the sheets constituting the tip bias stuck body V1 in the manufacturing process. Furthermore, the present inventor acquired a knowledge that a second cause is a generation of a wrinkle, a breakage or the like on the sheets constituting the tip bias stuck body V1 in the manufacturing process. The wrinkle, the breakage or the like causes a drawback in the winding operation for the tip bias layer. By these causes, it was proved that the physical property value of the shaft, particularly, the shaft torque value tends to be varied.

Figure 4:
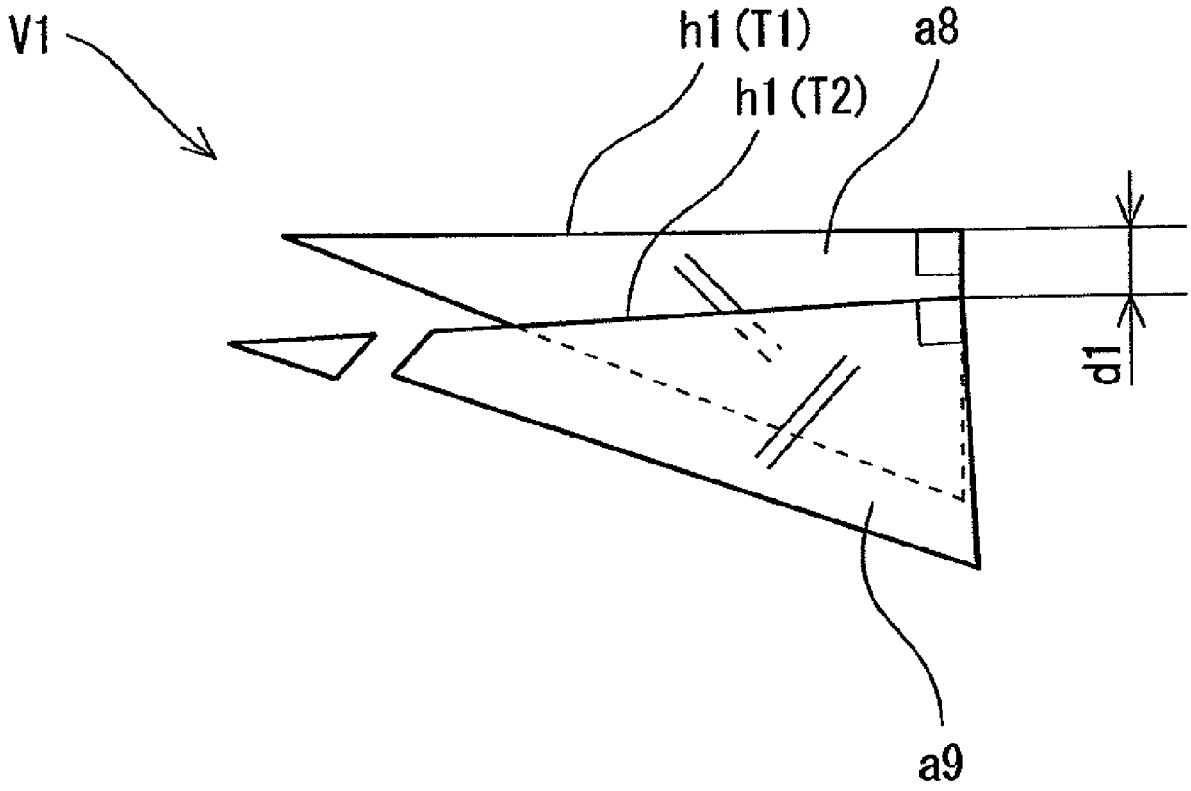
FIG. 4 is a view for explaining that a part of the tip bias sheet tends to disappear (lack)

It was found that the partial disappearance of the sheets tends to be caused when the peeling sheet (particularly, the releasing paper) is peeled from the tip bias stuck body V1. In the prepreg sheet, the fiber is oriented in a single direction. Therefore, the sheet tends to be torn in the orientation of the fiber. It was proved that the partial disappearance of the sheet is caused by the tear of the sheet. FIG. 4 is a view showing a state in which a part of the sheet falls off in the tip bias stuck body V1. By the tear in the orientation of the fiber, a part of the sheet falls off. A portion which tends to fall off is sharp in the bias sheet.

In the tip bias stuck body V1, a region in which the sheets a8 and a9 are stuck to each other is set to be a stuck region G1. In the stuck region G1, the sheets a8 and a9 overlap with each other. In the tip bias stuck body V1, the orientations of the fibers in the sheets a8 and a9 are different from each other. Because of the difference in the orientation, the sheets a8 and a9 suppress mutual tears each other. More specifically, the sheet a8 suppresses the tear of the sheet a9 and the sheet a9 suppresses the tear of the sheet a8. Similarly, the sheet a8 suppresses the wrinkle or breakage of the sheet a9 and the sheet a9 suppresses the wrinkle or breakage of the sheet a8. By forming and winding the tip bias stuck body V1, thus, it is possible to effectively suppress a defect or drawback of the tip bias layer.

Referring to the tip bias stuck body V1, a portion P1 which tends to fall off is a part which does not belong to the stuck region G1 and in which a fiber extended continuously from that part does not reach the stuck region G1. The sharp tip portion in the bias sheet can be the portion P1 which tends to fall off. Moreover, it was proved that the wrinkle or breakage tends to be generated in the portion P1.

Figure 5:
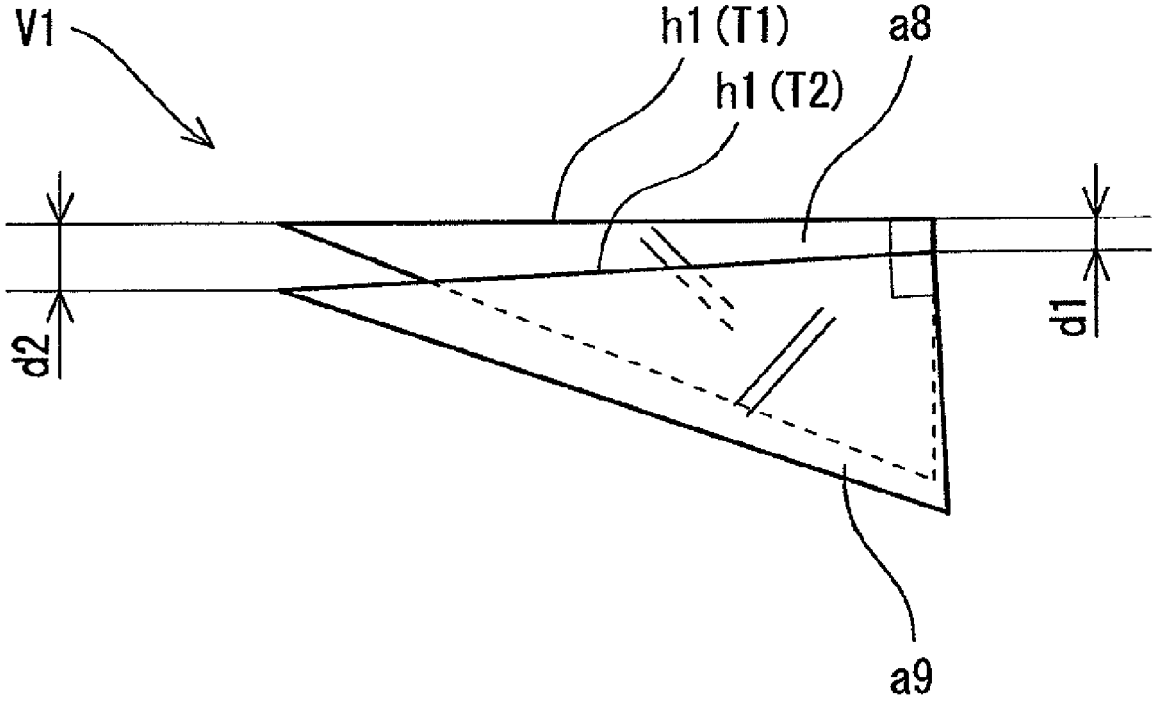
FIG. 5 is a view showing a tip bias stuck body in which distances d1 and d2 are reduced more greatly as compared with the embodiment of FIG. 3.

FIG. 5 shows another tip bias stuck body V1. In a configuration shown in FIG. 5, the distance d1 is smaller as compared with the configuration shown in FIG. 4. In the configuration shown in FIG. 5, the distance d2 is also smaller as compared with the configuration shown in FIG. 4. The embodiment shown in FIG. 4 and the embodiment shown in FIG. 5 are identical to each other except that the distances d1 and d2 are different. In the embodiment shown in FIG. 5, the portion P1 is smaller as compared with the embodiment shown in FIG. 4.

Figure 6:
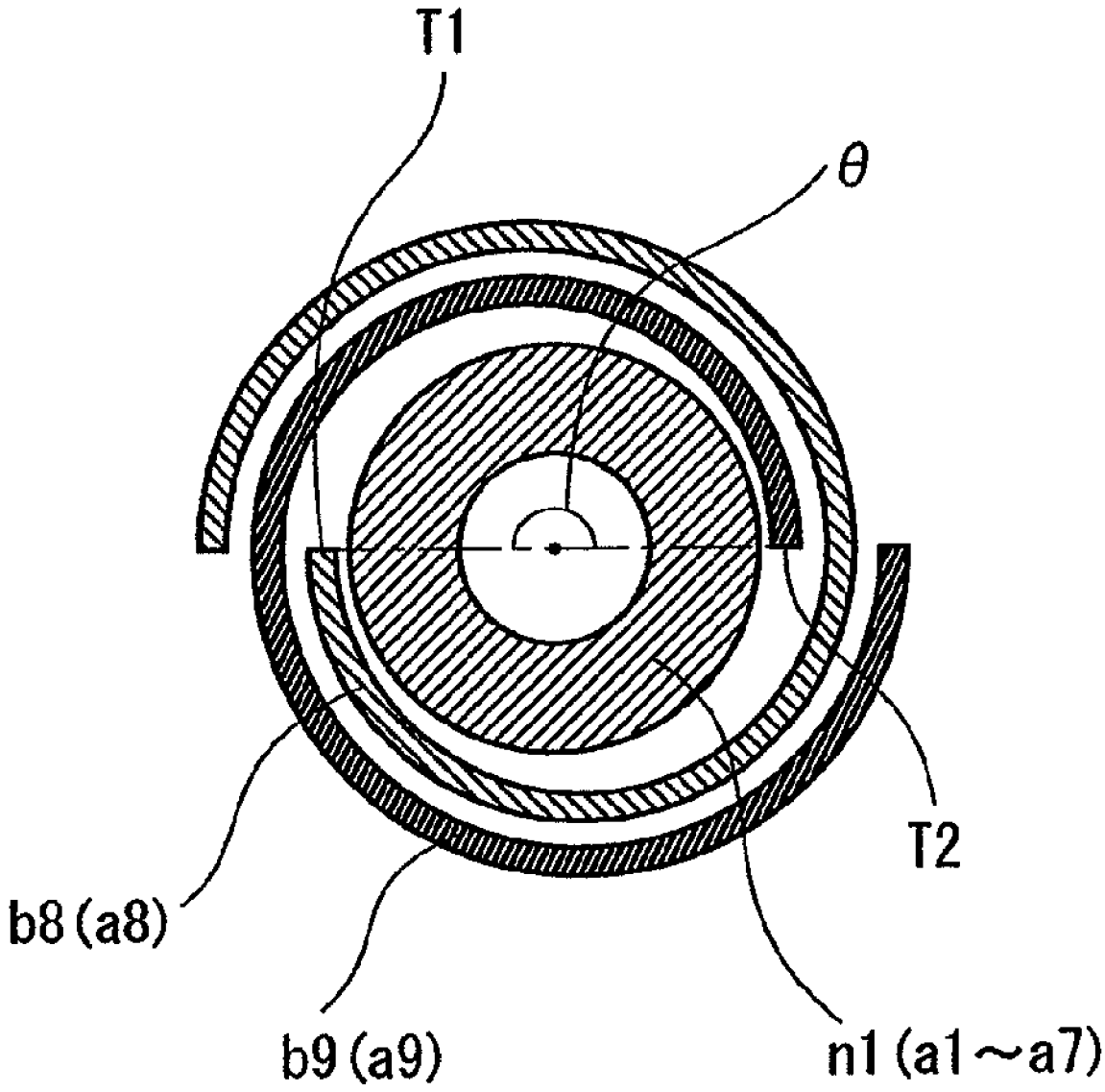
FIG. 6 is a sectional view corresponding to the embodiment of FIG. 3.
Figure 7:
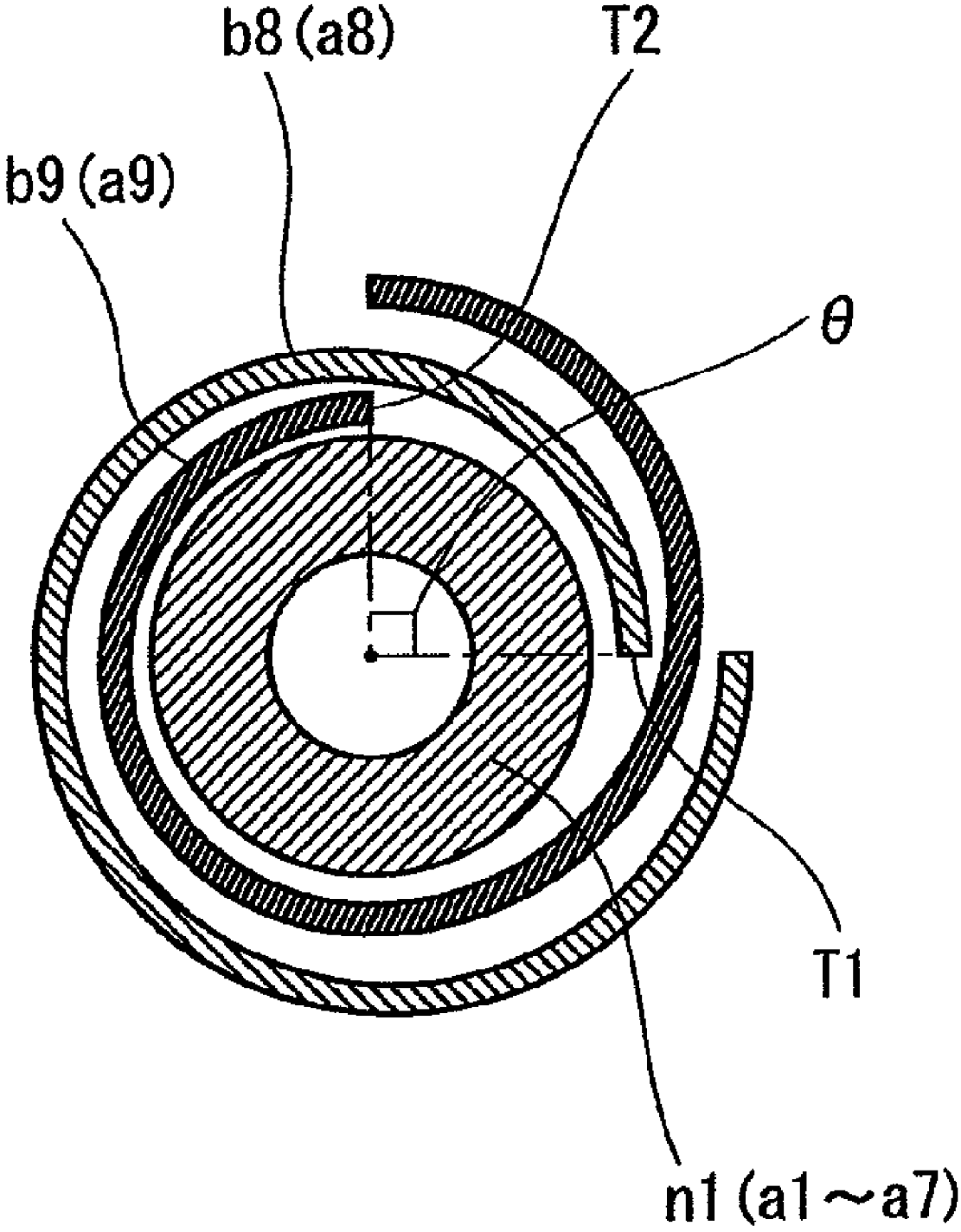
FIG. 7 is a sectional view corresponding to the embodiment of FIG. 5.

FIG. 6 is a sectional view showing the shaft 6 obtained by winding the tip bias stuck body V1 in FIG. 4 therearound, and FIG. 7 is a sectional view showing the shaft 6 obtained by winding the tip bias stuck body V1 in FIG. 5 therearound. In FIGS. 6 and 7, the angle difference θ is shown. The distances d1 and d2 and the angle difference θ are correlated with each other. FIGS. 6 and 7 show the sheets a8 and a9 which are wound. The wound sheet a8 constitutes a first tip bias layer b8. The wound sheet a9 constitutes a second tip bias layer b9. Thus, the angle difference θ is decreased when the distances d1 and d2 are reduced.

For easy understanding, in FIGS. 6 and 7, a proper clearance is provided between the layers of the tip bias layer. In an actual shaft, the clearance is not present. In FIGS. 6 and 7, moreover, the inner layer portion n1 obtained by winding the sheets a1 to a7 is shown as a single layer. Actually, the inner layer portion n1 is constituted by a large number of layers. In FIGS. 6 and 7, furthermore, the tip bias protective layer constituted by the sheet a10 is omitted. For easy understanding, in FIGS. 6 and 7, thicknesses of the first tip bias layer b8 and the second tip bias layer b9 are drawn more greatly than actual thicknesses.

FIGS. 6 and 7 are sectional views showing a state in which the sheet a8 (the first tip bias layer b8) and the sheet a9 (the second tip bias layer b9) are wound by one ply respectively. The numbers of plies of the first tip bias layer b8 and the second tip bias layer b9 are varied depending on the positions in the axial direction.

The angle difference θ is defined as follows. When an end on a winding start side of the first tip bias layer b8 is represented by T1 and an end on a winding start side of the second tip bias layer b9 is represented by T2, an angle difference between a position in a circumferential direction of the end T1 and a position in the circumferential direction of the end T2 is represented as the angle difference θ. In the sectional view showing the shaft, an angle formed by a straight line connecting the shaft axis and the end T1 and a straight line connecting the shaft axis and the end T2 is represented as the angle difference θ. In the present embodiment, the end T1 corresponds to the side h1 of the sheet a8. Moreover, the end T2 corresponds to the side h1 of the sheet a9. When the distances d1 and d2 are reduced, the angle difference θ is decreased.

When the angle difference θ is decreased, the distances d1 and d2 are reduced. When the distances d1 and d2 are reduced, the portion 21 which tends to fall off is lessened. In order to suppress a partial disappearance of the tip bias stuck body V1 and a winding failure, the angle difference θ is preferably equal to or smaller than 180 degrees, is more preferably equal to or smaller than 90 degrees, is more preferably equal to or smaller than 45 degrees, and is more preferably equal to or smaller than 10 degrees. The angle difference θ may be zero degree. FIG. 6 shows a state in which the angle difference θ is set to be 180 degrees. Moreover, FIG. 7 shows a state in which the angle difference θ is set to be 90 degrees.

In the embodiment shown in FIG. 2, the tip bias protective layer positioned on an outside of the tip bias layer is provided. The tip bias protective layer is constituted by the sheet a10. A length in the axial direction of the tip bias protective layer (the sheet a10) is greater than lengths in the axial direction of the sheets a8 and a9. In other words, the length in the axial direction of the tip bias protective layer (the sheet a10) is greater than a length in the axial direction of the tip bias stuck body V1. The tip bias protective layer is set to be a layer other than the bias layer. More specifically, an absolute value of an angle Af in the tip bias protective layer is smaller than 25 degrees or greater than 65 degrees. In the case in which the tip bias layer is polished at the polishing step, the physical property value of the shaft, for example, the shaft torque value tends to be varied depending on an amount of the polishing. In order to suppress the variation in the physical property value of the shaft, it is preferable that the tip bias protective layer should be provided. In order to increase a strength of the tip portion of the shaft, the tip bias protective layer is preferably a straight layer or a hoop layer and is more preferably the straight layer. In order to further suppress the variation in the physical property value of the shaft, it is preferable that the tip bias protective layer should cover the whole tip bias layer.

Figure 8:
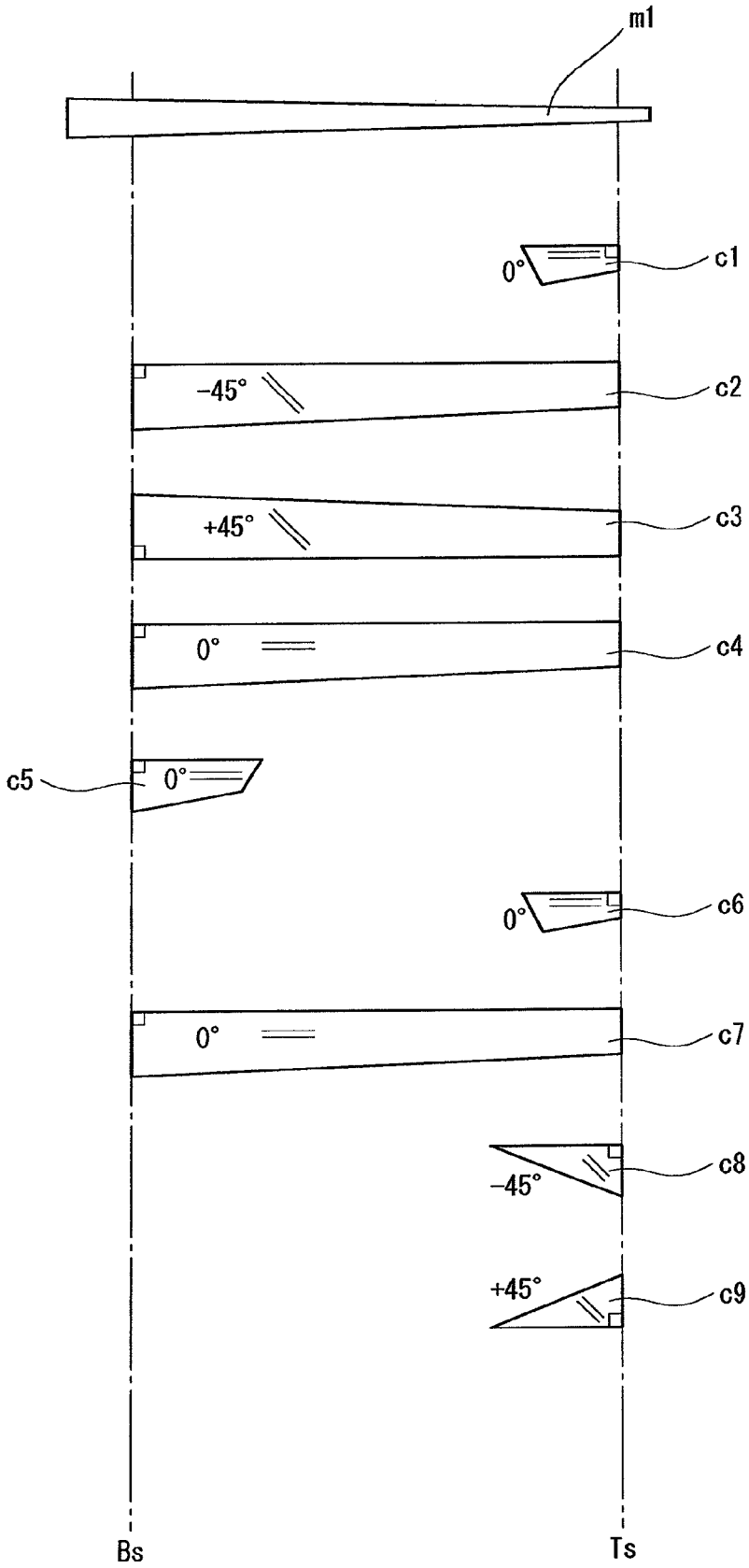
FIG. 8 is a developed view showing a shaft according to another embodiment.

FIG. 8 is a developed view showing a shaft according to another embodiment. In the embodiment shown in FIG. 8, the prepreg sheets c1 to c9 are wound sequentially. The embodiment shown in FIG. 8 is the same as the embodiment shown in FIG. 2 except that the sheet a10 constituting the tip bias protective layer is not present. In the shaft according to the present invention, thus, it is not necessary to provide the tip bias protective layer. As described above, it is preferable that the tip bias protective layer should be present.

Figure 9:
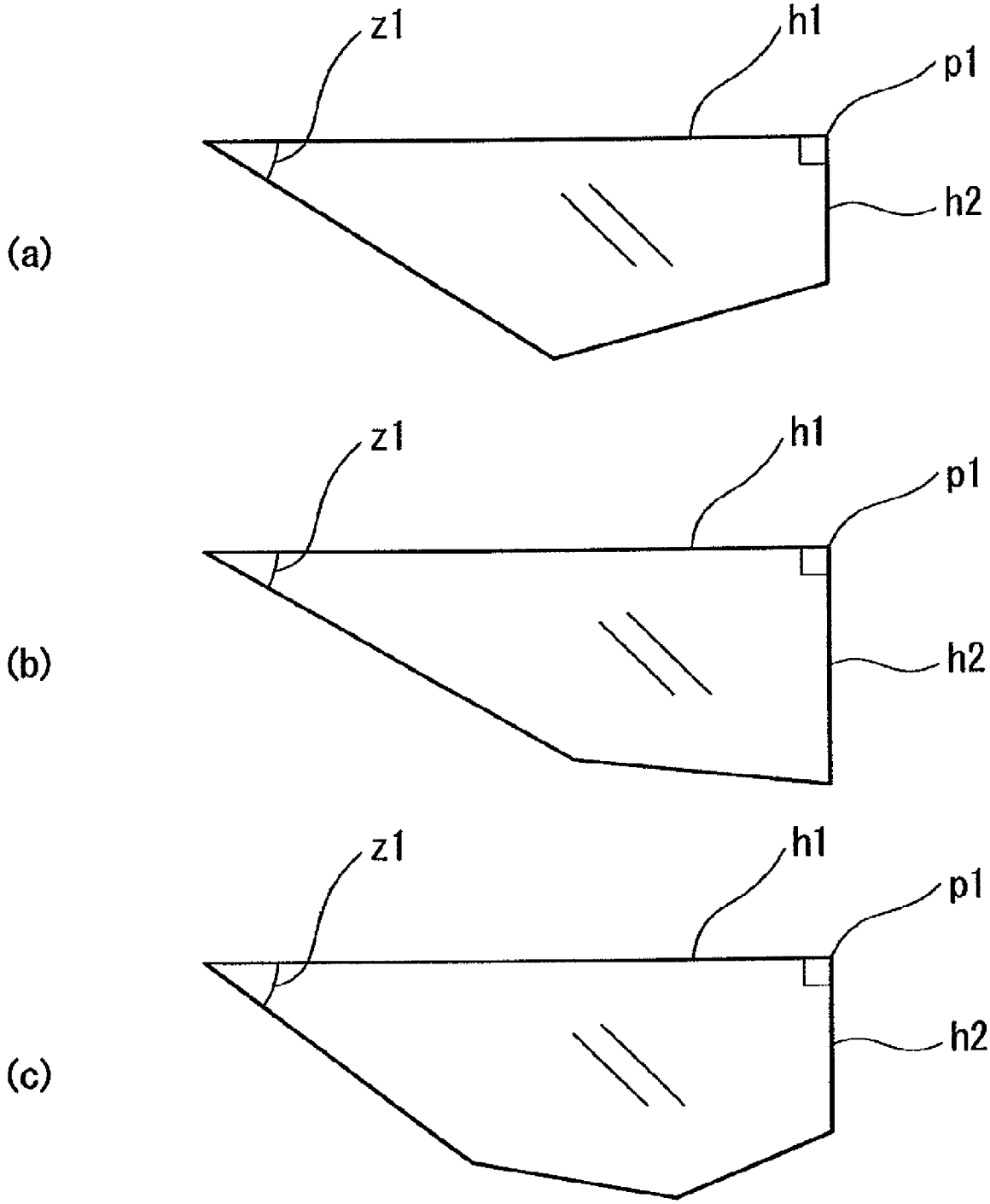
FIG. 9 is a view showing another example of the tip bias sheet.

FIG. 9 is a view showing another example of the tip bias sheet. Examples of a shape of the tip bias sheet include a triangle shown in FIG. 3, and furthermore, squares shown in FIGS. 9(*a*) and 9(*b*) and a pentagon shown in FIG. 9(*c*). Three types of tip bias sheets shown in FIG. 9 have the sides h1 and h2. The sides h1 and h2 are orthogonal to each other. The side h1 is disposed in almost parallel with the axial direction of the shaft. Ideally, the side h1 is disposed in parallel with the axial direction of the shaft. The bias sheet shown in FIG. 9 is also used by sticking two sheets in the same manner as the bias sheet shown in FIG. 3. The side h2 is disposed on the tip end Ts. It is preferable that the tip bias sheet should have an acute angle z1 on the butt end Bt side in the axial direction of the shaft. By the acute angle z1, a rigidity or the like is prevented from being rapidly changed at the end of the tip bias sheet. By the presence of the acute angle z1, moreover, a lack, a wrinkle, a breakage or the like of the sheet in the tip bias stuck body V1 tends to be generated. Therefore, the advantage of the present invention can be still more remarkable.

Figure 10:
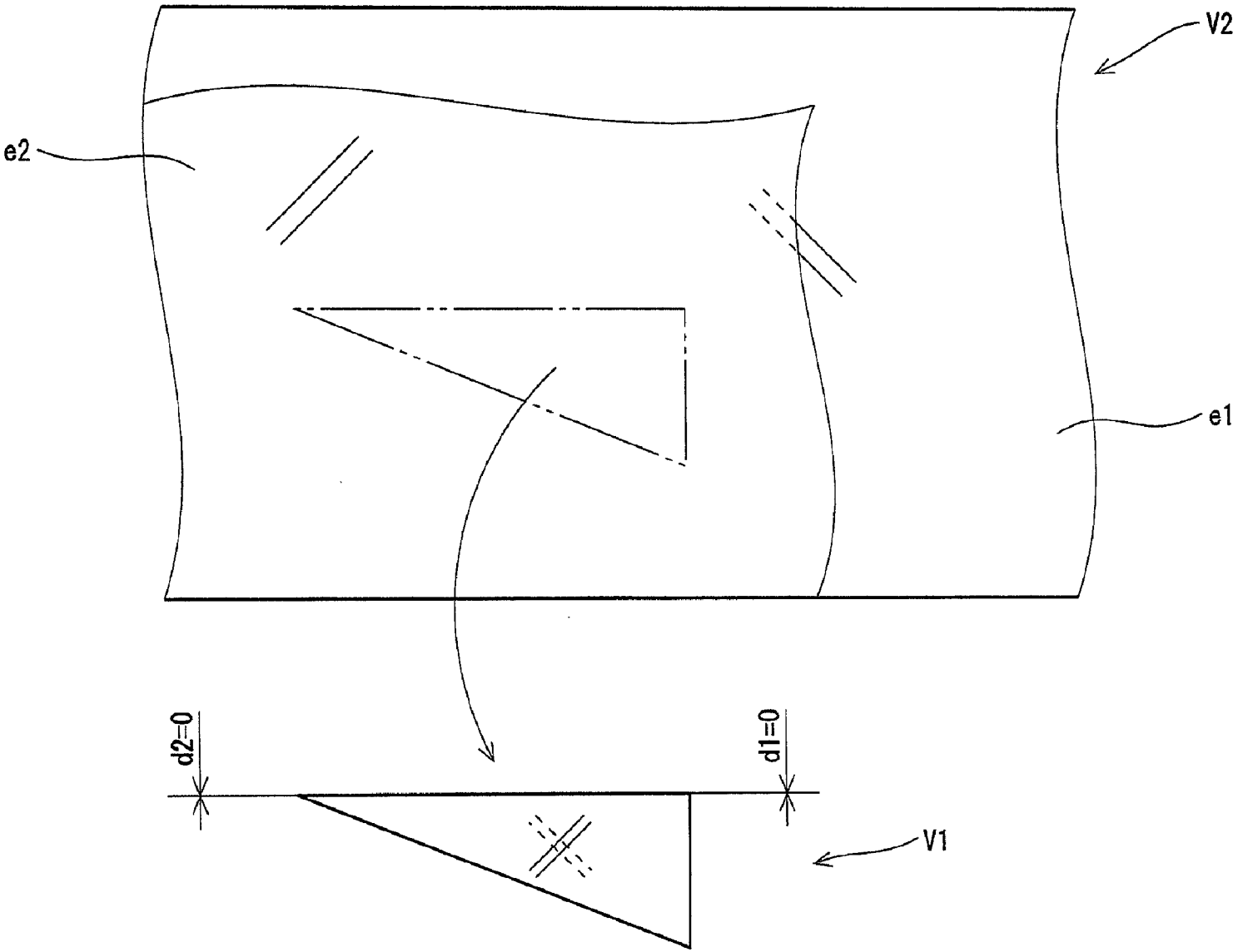
FIG. 10 is a view for explaining another method of manufacturing the tip bias stuck body.

The method of manufacturing the tip bias stuck body V1 is not restricted to the foregoing. FIG. 10 is a view for explaining another method of manufacturing the tip bias stuck body V1. In the manufacturing method, a cutting step is carried out after a sticking step. Referring to a shaft according to another embodiment, a fabricating method for the tip bias stuck body V1 is different. In the shaft, a first sheet e1 for a first tip bias sheet and a second sheet e2 for a second tip bias sheet are used. An orientation of a fiber of the first sheet e1 is different from an orientation of a fiber of the second sheet e2. An area of an overlapping portion in which the first sheet e1 and the second sheet e2 overlap with each other is larger than an area of the tip bias sheet. In the first sheet e1 and the second sheet e2, the tip bias sheet has not been cut yet.

As shown in FIG. 10, in the present embodiment, the first sheet e1 and the second sheet e2 are stuck together to form a stuck body V2. Next, the stuck body V2 is cut. An overlapping portion in which the first sheet e1 and the second sheet e2 overlap with each other is cut. In FIG. 10, a two-dotted chain line indicates a cutting line for the cutting operation. The stuck body V2 is cut along the cutting line. By the cutting operation, the first tip bias sheet and the second tip bias sheet are formed, and at the same time, the tip bias stuck body V1 is formed. In the tip bias stuck body V1, accordingly, the first tip bias sheet and the second tip bias sheet are caused to overlap without a shift. In the tip bias stuck body V1, therefore, distances d1 and d2 are zero. An orientation of a fiber of the first sheet e1 and an orientation of a fiber of the second sheet e2 are adjusted to obtain a desirable combination of the orientation of the fiber in the tip bias stuck body V1. In the present embodiment, the distances d1 and d2 are zero. Therefore, the angle difference θ is also zero degree. In the present embodiment, the sticking step is simplified. Consequently, a productivity can be enhanced. It is more preferable that the cutting operation should be carried out in a state in which a plurality of stuck bodies V2 is superposed. By the method, it is possible to obtain a plurality of tip bias stuck bodies V1 through a single cutting operation.

A double arrow L1 in FIG. 3 indicates a length in an axial direction of the tip bias layer. In order to enhance the effect for reducing the shaft torque value, the length L1 is preferably equal to or higher than 10% of a full length L of the shaft and is more preferably equal to or greater than 12%, and is more preferably equal to or greater than 15%. In order to reduce the portion P1 and to enhance a workability of the winding operation for the tip bias stuck body, the length L1 is preferably equal to or smaller than 50% of the full length of the shaft, is more preferably equal to or smaller than 40% and is more preferably equal to or smaller than 35%.

In order to enhance the effect for protecting the tip bias layer from polishing, a maximum number of plies of the tip bias protective layer is preferably equal to or greater than one and is more preferably equal to or greater than two. In order to suppress an excessive increase in a weight of the shaft and to properly set a tip diameter of the shaft, the maximum number of the plies of the tip bias protective layer is preferably equal to or smaller than eight and is more preferably equal to or smaller than seven. The maximum number of the plies indicates a maximum value of the number of the plies in the case in which the number of the plies of the tip bias layer is varied depending on the position in the axial direction of the shaft.

In order to enhance the effect for protecting the tip bias layer from the polishing, a minimum number of the plies of the tip bias protective layer present on an outside of the tip bias layer is preferably equal to or greater than one and is more preferably equal to or greater than two. In order to suppress the excessive increase in the weight of the shaft and to properly set the tip diameter of the shaft, a minimum number of the plies is preferably equal to or smaller than four and is more preferably equal to or smaller than three. The minimum number of the plies indicates a minimum value of the number of the plies in the case in which the number of the plies of the tip bias layer is varied depending on the position in the axial direction of the shaft. The number of the plies implies the number of winding operations (the number of revolutions). For example, in the case in which a layer exactly makes a revolution in the circumferential direction of the shaft, the number of the plies is one. For example, in the case in which the layer makes one and half revolutions in the circumferential direction of the shaft, the number of the plies is 1.5.

A double arrow L2 in FIG. 2 indicates a length in the axial direction of the tip bias protective layer. In order to enhance the effect for protecting the tip bias layer from the polishing, a ratio (L2/L1) of the length L2 to the length L1 is preferably equal to or higher than 1.00, is more preferably equal to or higher than 1.05, and is more preferably equal to or higher than 1.1. In some cases in which the ratio (L2/L1) is excessively high, a characteristic of the shaft is excessively changed so that the purpose for protecting the tip bias layer cannot be accomplished. In these cases, there is a possibility that a degree of freedom of a design in the shaft might be excessively restricted. In the case in which the ratio (L2/L1) is excessively high, moreover, the weight of the shaft might be excessively increased by the tip bias protective layer. From these viewpoints, the ratio (L2/L1) is preferably equal to or lower than 150%, is more preferably equal to or lower than 140%, and is more preferably equal to or lower than 130%.

In respect of an easy swing, it is preferable that the full length of the shaft should be equal to or greater than 762 mm. Moreover, the present invention can produce a greater effect in a shaft for a wood club for which a light weight and a small torque value are required. From this viewpoint, the full length of the shaft is preferably equal to or greater than 965 mm and is more preferably equal to or greater than 1080 mm. In order to enhance a probability of a nice shot (a meet rate) and to comply with golf rules, the full length of the shaft is preferably equal to or smaller than 1219 mm, is more preferably equal to or smaller than 1181 mm and is more preferably equal to or smaller than 1168 mm.

In respect of a durability and a strength of the shaft, it is preferable that a total number of the full-length sheets should be equal to or greater than three. In order to enhance a productivity and to suppress an excessive increase in the weight of the shaft, the total number of the full-length sheets is preferably equal to or smaller than eight and is more preferably equal to or smaller than six.

In respect of the durability and the strength of the shaft, it is preferable that the full-length sheet should include at least one straight sheet. In respect of the productivity, it is preferable that the number of the plies of the straight layer constituting the full-length sheet should be equal to or greater than one. In respect of the durability and the strength of the shaft, it is preferable that the full-length sheet should include at least two (one set of) full-length bias sheets.

In order to maintain a weight of the straight layer and to thus increase the strength of the shaft while providing the tip bias layer, the weight of the shaft is preferably equal to or greater than 40 g, is more preferably equal to or greater than 45 g, and is more preferably equal to or greater than 50 g. In the case in which the weight of the shaft is great, the torque value can be decreased by the full-length bias layer. On the other hand, the tip bias layer according to the present invention can achieve a light weight and a small torque value. Accordingly, the present invention is preferably applied to a shaft having a weight of 70 g or less and is more preferably applied to a shaft having a weight of 65 g or less.

The tip bias layer according to the present invention is effective for decreasing the torque value. From this view point, the shaft torque value is preferably equal to or smaller than 4.5, is more preferably equal to or smaller than 4.0 and is more preferably equal to or smaller than 3.5. In consideration of the preferable weight of the shaft and a practical strength of the shaft, a lower limit of the shaft torque value is usually equal to or greater than 1.5. A method of measuring the shaft torque value will be described below.

In order to enhance the strength and the productivity, thicknesses of the full-length sheet and the partial sheet are preferably equal to or greater than 0.025 mm, are more preferably equal to or greater than 0.058 mm, and are further preferably equal to or greater than 0.083 mm. In respect of a lightweight property, the thicknesses of the full-length sheet and the partial sheet are preferably equal to or smaller than 0.150 mm, are more preferably equal to or smaller than 0.145 mm, and are further preferably equal to or smaller than 0.136 mm.

In respect of the strength and a reduction in the weight, fiber contents of the full-length sheet and the partial sheet are preferably equal to or higher than 60% by weight, are more preferably equal to or higher than 63% by weight, and are further preferably equal to or higher than 70% by weight. In the case in which the fiber content is excessively high, a content of the matrix resin is decreased. Therefore, a tacking property of the sheet is deteriorated. By the deterioration in the tacking property, a winding failure such as a wrinkle tends to be generated. From this viewpoint, the fiber contents of the full-length sheet and the partial sheet are preferably equal to or lower than 85% by weight, are more preferably equal to or lower than 80% by weight and are further preferably equal to or lower than 75% by weight.

A shape of the full-length sheet is not restricted. In the case in which the number of plies is equal in all positions in the axial direction of the shaft, the shape of the full-length sheet is a trapezoid shown in FIG. 2. In these full-length sheets, a sheet width is gradually reduced closer to the tip end Ts. The shape of the sheet corresponds to the taper shape of the shaft.

The partial sheet and the full-length sheet have the side h1 (see FIG. 2). An absolute value of an angle formed by the side h1 and the axial direction of the shaft is preferably equal to or smaller than 10 degrees and is more preferably equal to or smaller than 5 degrees. The side h1 is set to be parallel with the axial direction of the shaft so that the fiber orientation is made proper. In order to cause the side h1 to be parallel with the axial direction of the shaft, the winding start edge portion is stuck in the axial direction of the shaft at the winding step.

A specific example of the prepreg sheet which can be used in the present invention is not restricted. In respect of the strength and a modulus of elasticity, a carbon fiber is preferable for a fiber constituting the prepreg sheet. In respect of the strength, it is preferable that a tensile strength of a fiber constituting the sheet should be equal to or greater than 300 kgf/mm$^2$. In consideration of a physical property of the carbon fiber which is available, it is preferable that the tensile strength of the fiber should be equal to or smaller than 680 kgf/mm$^2$.

In order to control the shaft torque value, a tensile modulus of elasticity of the fiber contained in the tip bias layer is preferably equal to or higher than 30 t/mm$^2$ and is more preferably equal to or higher than 40 t/mm$^2$. In order to increase the strength of the shaft tip portion, it is preferable that the tensile modulus of elasticity of the fiber contained in the tip bias layer should be equal to or lower than 70 t/mm$^2$. In respect of the strength, it is preferable that the tensile strength of the fiber constituting the sheet should be equal to or greater than 300 kgf/mm$^2$. The tensile strength and the tensile modulus of elasticity of the fiber have values measured in accordance with the JIS R7601:1986 "a carbon fiber testing method".

A thermosetting resin, a thermoplastic resin and the like other than an epoxy resin can also be used for the matrix resin of the prepreg sheet in addition to the epoxy resin. In respect of the strength of the shaft, the epoxy resin is preferable for the matrix resin.

EXAMPLES

Although the advantages of the present invention will be apparent from examples, the present invention should not be construed restrictively based on description of the examples.

Example 1

The shaft in the developed view of FIG. 8 (the view showing a structure of a sheet) was fabricated. At a sticking step, two full-length bias sheets (the sheets c2 and c3 in FIG. 8) were stuck together to obtain a full-length bias stuck body. At the sticking step, moreover, two tip bias sheets (the sheets c8 and c9 in FIG. 8) were stuck together to obtain a tip bias stuck body. The stuck bodies and the other sheets were wound in order from the sheet on an upper side in FIG. 8. A polishing step and previous steps were carried out in accordance with the above-mentioned shaft manufacturing process so that a shaft according to an example 1 was obtained. When an end on a winding start side of a first full-length bias layer (corresponding to the sheet c2 in FIG. 8) is represented by Ta and an end on a winding start side of a second full-length bias layer (corresponding to the sheet c3 in FIG. 8) is represented by Tb, an angle difference θf between a position in a circumferential direction of the end Ta and a position in the circumferential direction of the end Tb was set to be 180 degrees. More specifically, the full-length bias stuck body was fabricated in such a manner that the angle difference θf is 180 degrees. Moreover, an angle difference θ related to the tip bias layer was set to be 180 degrees. The angle Af in the full-length bias layer was set to be +45 degrees and −45 degrees. The angle Af in the tip bias layer was set to be +45 degrees and −45 degrees. In the example 1, a tip bias protective layer was not provided.

A trade name "TR350C-100S" manufactured by Mitsubishi Rayon Co., Ltd. was used for a first sheet (the sheet c1), a trade name "HRX350C-110S" manufactured by the Mitsubishi Rayon Co., Ltd. was used for second and third sheets (the full-length bias sheets c2 and c3), a trade name "MR350C-125S" manufactured by the Mitsubishi Rayon Co., Ltd. was used for a fourth sheet (the full-length straight sheet c4), the trade name "HRX350C-110S" manufactured by the Mitsubishi Rayon Co., Ltd. was used for a fifth sheet (the rear end straight sheet c5), a trade name "MR350C-100S" manufactured by the Mitsubishi Rayon Co., Ltd. was used for a six sheet (the tip straight sheet c6), a trade name "MR350C-150S" manufactured by the Mitsubishi Rayon Co., Ltd. was used for a seventh sheet (the full-length straight sheet c7), and a trade name "HRX350C-075S" manufactured by the Mitsubishi Rayon Co., Ltd. was used for eighth and ninth sheets (the tip bias sheets c8 and c9). In the "HRX350C-110S" and the "HRX350C-075S", a tensile modulus of elasticity of the fiber is 40 t/mm$^2$.

Fifty shafts according to the example 1 were manufactured and a shaft torque value was measured for each of the shafts by a method which will be described below. Based on data on the fifty shaft torque values, a standard deviation was calculated. The standard deviation of the shaft torque value was 0.18.

Example 2

The shaft in the developed view of FIG. 2 (the view showing a structure of a sheet) was fabricated. At a sticking step, two full-length bias sheets (the sheets a2 and a3 in FIG. 2) were stuck together to obtain a full-length bias stuck body. At the sticking step, moreover, two tip bias sheets (the sheets a8 and a9 in FIG. 2) were stuck together to obtain a tip bias stuck body. The stuck bodies and the other sheets were wound in order from the sheet on an upper side in FIG. 2. A polishing step and previous steps were carried out in accordance with the above-mentioned shaft manufacturing process so that a shaft according to an example 2 was obtained. When an end on a winding start side of a first full-length bias layer (corresponding to the sheet a2 in FIG. 2) is represented by Ta and an end on a winding start side of a second full-length bias layer (corresponding to the sheet a3 in FIG. 2) is represented by Tb, an angle difference θf between a position in a circumferential direction of the end Ta and a position in the circumferential direction of the end Tb was set to be 180 degrees. More specifically, the full-length bias stuck body was fabricated in such a manner that the angle difference θf is 180 degrees. Moreover, an angle difference θ related to the tip bias layer was set to be 180 degrees. The angle Af in the full-length bias layer was set to be +45 degrees and −45 degrees. The angle Af in the tip bias layer was set to be +45 degrees and −45 degrees. In the example 2, a tip bias protective layer (the sheet a10) was provided. The tip bias protective layer was set to be a straight layer.

A trade name "TR350C-100S" manufactured by Mitsubishi Rayon Co., Ltd. was used for a first sheet (the sheet a1), a trade name "HRX350C-110S" manufactured by the Mitsubishi Rayon Co., Ltd. was used for second and third sheets (the full-length bias sheets a2 and a3), a trade name "MR350C-125S" manufactured by the Mitsubishi Rayon Co., Ltd. was used for a fourth sheet (the full-length straight sheet a4), the trade name "HRX350C-110S" manufactured by the Mitsubishi Rayon Co., Ltd. was used for a fifth sheet (the rear end straight sheet a5), a trade name "MR350C-100S" manufactured by the Mitsubishi Rayon Co., Ltd. was used for a six sheet (the tip straight sheet a6), a trade name "MR350C-150S" manufactured by the Mitsubishi Rayon Co., Ltd. was used for a seventh sheet (the full-length straight sheet a7), a trade name "HRX350C-075S" manufactured by the Mitsubishi Rayon Co., Ltd. was used for eighth and ninth sheets (the tip bias sheets a8 and a9), and a trade name "TR350C-100S" manufactured by the Mitsubishi Rayon Co., Ltd. was used for a tenth sheet (the sheet a10 for the tip protective layer). Moreover, a shape of a mandrel and dimensions of the first to ninth sheets were set to be equal to them in the example 1.

Fifty shafts according to the example 2 were manufactured and a standard deviation was calculated for each of the shafts in the same manner as in the example 1. A standard deviation of a shaft torque value was 0.15.

Example 3

A shaft according to an example 3 was obtained in the same manner as in the example 2 except that the angle difference θ related to a tip bias layer was set to be 90 degrees. Fifty shafts according to the example 3 were manufactured and a standard deviation was calculated for each of the shafts in the same manner as in the example 1. A standard deviation of a shaft torque value was 0.12.

Example 4

A shaft according to an example 4 was obtained in the same manner as in the example 2 except that the angle difference θ related to a tip bias layer was set to be zero degree. Fifty shafts according to the example 4 were manufactured and a standard deviation was calculated for each of the shafts in the same manner as in the example 1. A standard deviation of a shaft torque value was 0.07.

Example 5

A shaft according to an example 5 was obtained in the same manner as in the example 2 except that a tip bias stuck body was fabricated in the same manner as in the embodiment shown in FIG. 10. In the shaft, necessarily, the angle difference θ is zero degree. Fifty shafts according to the example 5 were manufactured and a standard deviation was calculated for each of the shafts in the same manner as in the example 1. A standard deviation of a shaft torque value was 0.06.

Comparative Example 1

Figure 11:
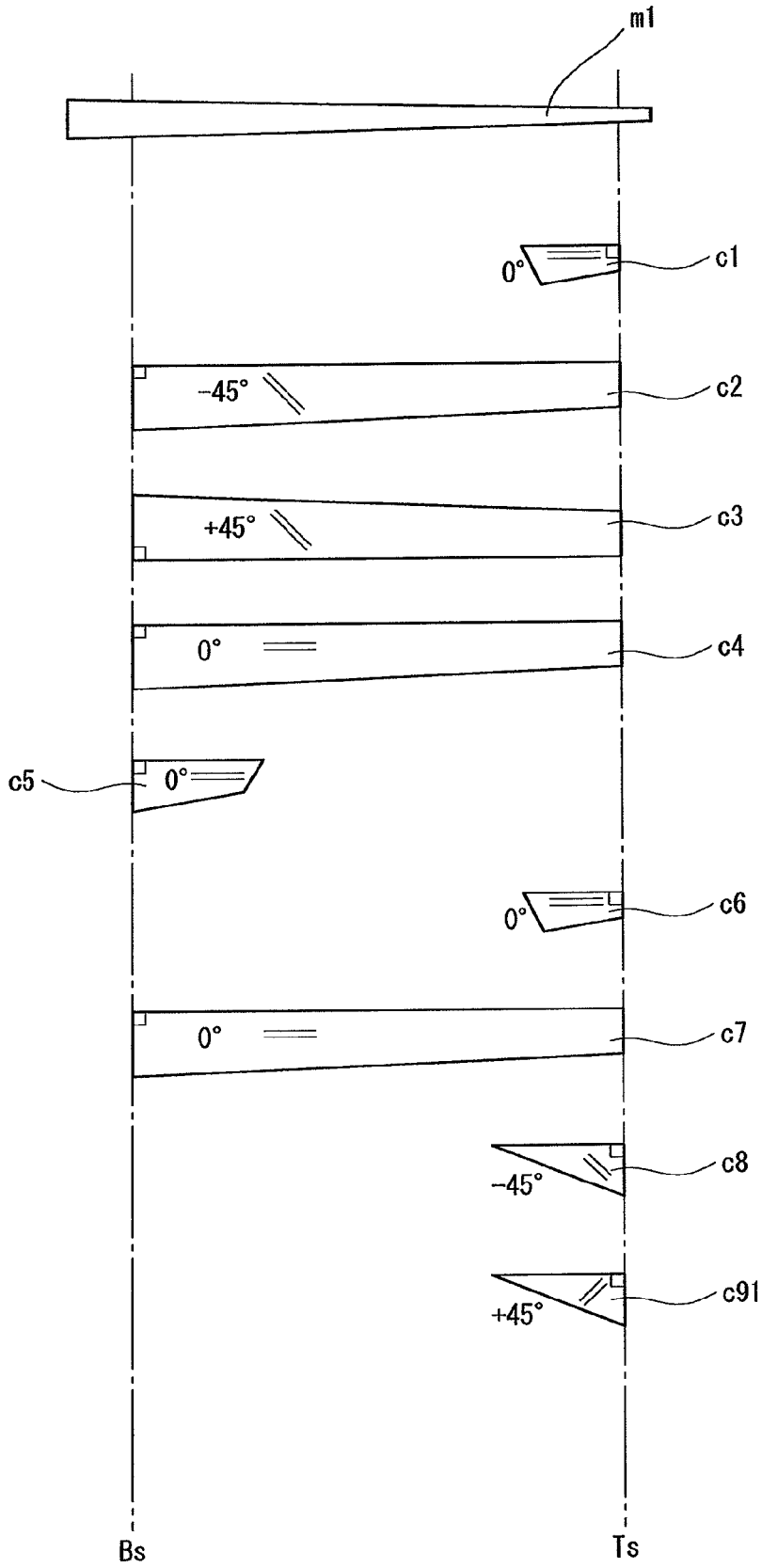
FIG. 11 is a developed view showing a comparative example 1.

A developed view for a comparative example 1 is shown in FIG. 11. Dimensions of all sheets are the same as those in the example 1. Only a difference between FIGS. 8 and 11 is that back and right sides of the ninth sheet are reversed. More specifically, when the sheet c9 in FIG. 8 is turned over, it is the same as a sheet c91 in FIG. 11. In other words, the sheet c91 seen from a surface on a film side is the same as the sheet c9 seen from a surface on a releasing paper side. As a matter of course, an angle Af of a tip bias layer formed by the sheet c91 is +45 degrees in the comparative example 1, and an angle Af of a tip bias layer formed by the sheet c9 is also +45 degrees in the example 1. A tip bias stuck body was not fabricated but the first tip bias sheet c8 and the second tip bias sheet c91 were wound separately from each other. More specifically, the first tip bias sheet c8 was wound and the second tip bias sheet c91 was then wound. A shaft according to the comparative example 1 was obtained in the same manner as in the example 1 except as described above. Fifty shafts according to the comparative example 1 were manufactured and a standard deviation was calculated for each of the shafts in the same manner as in the example 1. A standard deviation of a shaft torque value was 0.24.

Comparative Example 2

Figure 12:
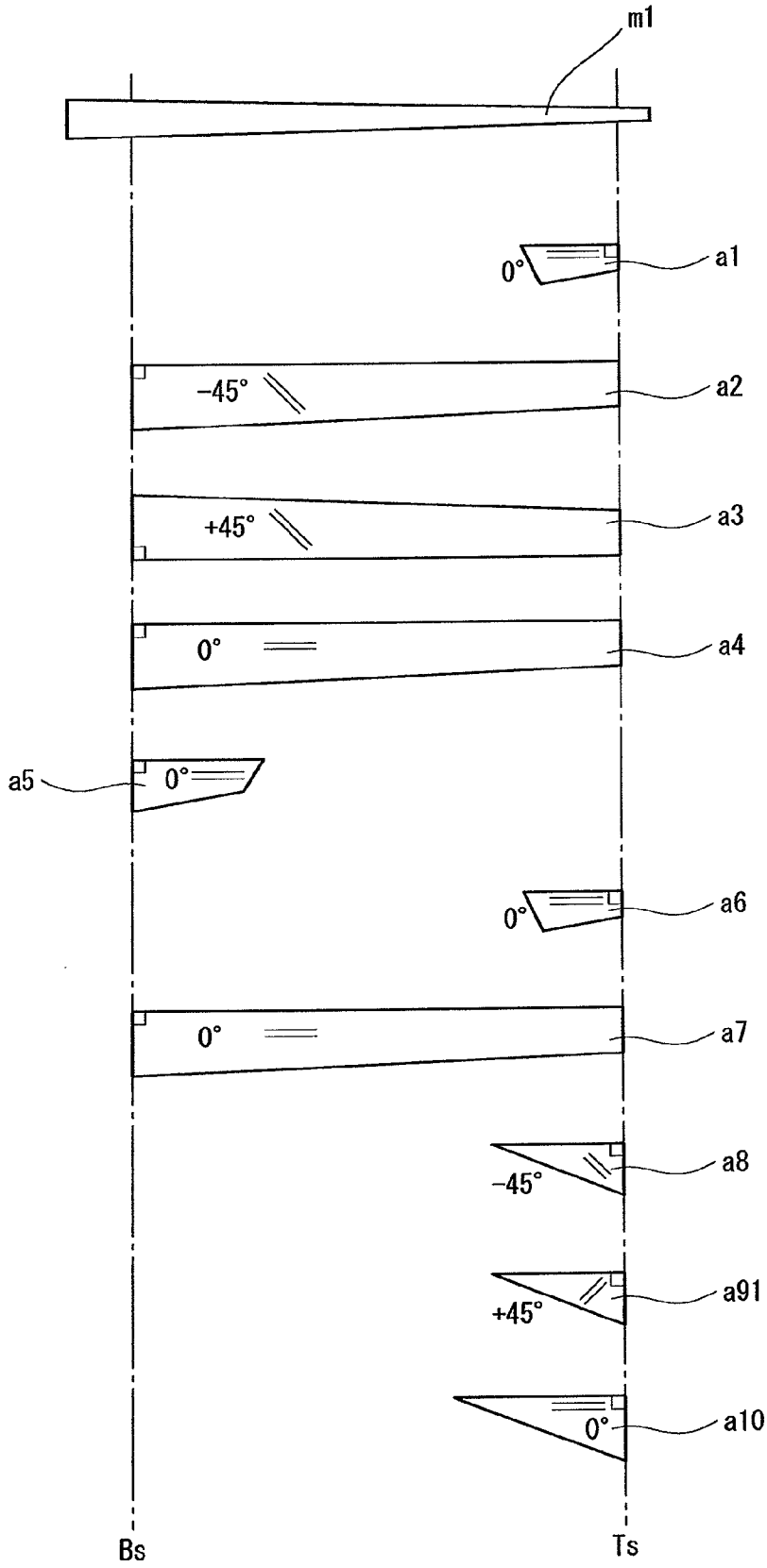
FIG. 12 is a developed view showing a comparative example 2.

A developed view for a comparative example 2 is shown in FIG. 12. Dimensions of all sheets are the same as those in the example 2. Only a difference between FIGS. 2 and 12 is that back and right sides of the ninth sheet are reversed. More specifically, when the sheet a9 in FIG. 2 is turned over, it is the same as a sheet a91 in FIG. 12. In other words, the sheet a91 seen from a surface on a film side is the same as the sheet a9 seen from a surface on a releasing paper side. As a matter of course, an angle Af of a tip bias layer formed by the sheet a91 is +45 degrees in the comparative example 2, and an angle Af of a tip bias layer formed by the sheet a9 is also +45 degrees in the example 2. A tip bias stuck body was not fabricated but a first tip bias sheet a8 and the second tip bias sheet a91 were wound separately from each other. More specifically, the first tip bias sheet a8 was wound and the second tip bias sheet a91 was then wound. A shaft according to the comparative example 2 was obtained in the same manner as in the example 2 except as described above. Fifty shafts according to the comparative example 2 were manufactured and a standard deviation was calculated for each of the shafts in the same manner as in the example 1. A standard deviation of a shaft torque value was 0.20.

Figure 13:
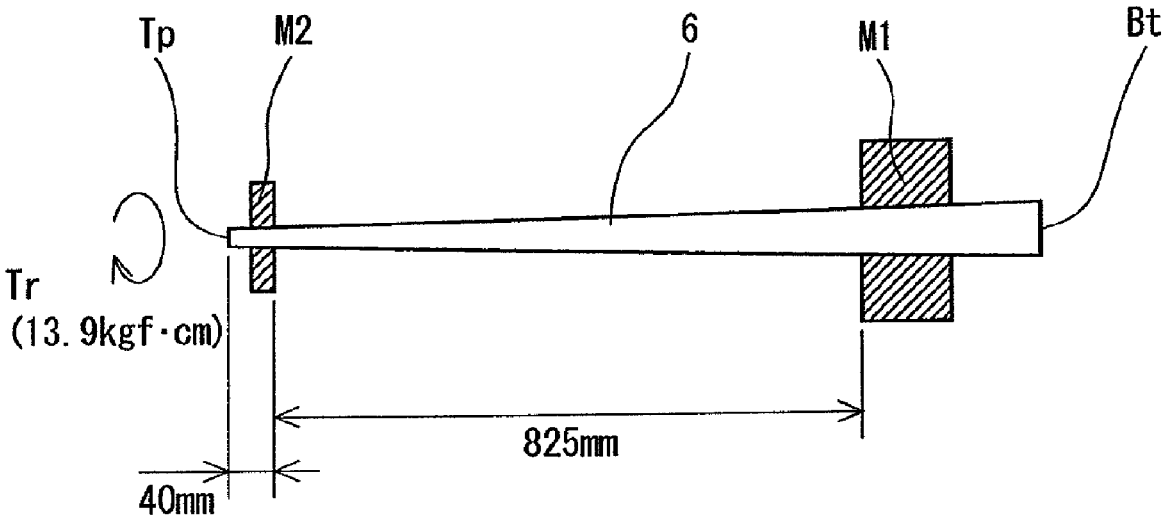
FIG. 13 is a view showing a method of measuring a shaft torque value.

FIG. 13 shows a method of measuring the shaft torque value. As shown in FIG. 13, in the measuring method, a rear end of a shaft 6 is fixed unrotatably by means of a jig M1, and furthermore, a tip portion of the shaft 6 is held by a jig M2 to cause a torque Tr of 13.9 kgf·cm to act on a position of 40 mm from a tip end Tp. A twist angle (degree) of the shaft in the torque acting position is set to be a shaft torque value. A rotating speed of the jig M2 in the loading of the torque Tr is set to be equal to or lower than 130°/minute and a length in an axial direction between the jigs M1 and M2 is set to be 825 mm. Furthermore, it is assumed that a core material or the like is put in the shaft 6 to carry out the measurement in the case in which the shaft 6 is deformed by the hold of the jig M1 or M2. By the method, the shaft torque value was measured.

A durability test was carried out in all of the examples and the comparative examples. Consequently, an excellent result was obtained. The durability test was performed in the following manner. A head and a grip were attached to a shaft to fabricate a golf club. The golf club was attached to a trade name of "SHOT ROBO III-1" manufactured by MIYAMAE CO., LTD. and was caused to repetitively hit a golf ball at a head speed of 54 m/s. 1500 shots were made on a toe side of a face, and furthermore, 1500 shots were made on a heel side of the head. As a result, a breakage of the shaft or the like was not observed in any of the examples and comparative examples.

As described above, there was obtained a result that the standard deviation in the example 1 was smaller than that in the comparative example 1. Moreover, it was found that the standard deviation in the example 2 is smaller than that in the comparative example 2 and is smaller than that in the example 1. The standard deviation in the example 3 was further smaller than that in the example 2. The standard deviation in the example 4 was further smaller than that in the example 3. The standard deviation in the example 5 was equivalent to that in the example 4 and a productivity in the example 5 was higher than that in the example 4. From the results of the evaluation, the advantages of the present invention are obvious.

The present invention can be applied to all shafts for golf clubs, for example, a shaft for a wood type golf club, a shaft for an iron type golf club, a shaft for a patter and the like.

The above description is only illustrative and various changes can be made without departing from the scope of the present invention.

What is claimed is:

1. A shaft for a golf club which is obtained by winding and curing a prepreg sheet having a matrix resin and a fiber, the prepreg sheet including a full-length sheet provided wholly in an axial direction of the shaft and a partial sheet provided in a part in the axial direction of the shaft, wherein at least a part of the partial sheet forms a tip bias layer disposed in a tip portion of the shaft, the tip bias layer has a first tip bias layer and a second tip bias layer, a fiber of the first tip bias layer is oriented at an angle which is equal to or greater than −65 degrees and is equal to or smaller than −25 degrees with respect to an axis of the shaft, a fiber of the second tip bias layer is oriented at an angle which is equal to or greater than 25 degrees and is equal to or smaller than 65 degrees with respect to the axis of the shaft, there is wound a tip bias stuck body having a first tip bias sheet to be a sheet for the first tip bias layer and a second tip bias sheet to be a sheet for the second tip bias layer which are stuck together, and when an end on a winding start side of the first tip bias layer is represented by T1 and an end on a winding start side of the second tip bias layer is represented by T2, an angle difference θ between a position in a circumferential direction of the end T1 and a position in the circumferential direction of the end T2 is equal to or smaller than 90 degrees.

2. The shaft for a golf club according to claim 1, wherein a stuck body fabricated by sticking a first sheet for the first tip bias sheet and a second sheet for the second tip bias sheet together is cut so that the first tip bias sheet and the second tip bias sheet are formed and the tip bias stuck body is simultaneously formed.

3. The shaft for a golf club according to claim 1, wherein the partial sheet includes a tip bias protective layer disposed in the tip portion of the shaft, and the tip bias protective layer covers the whole tip bias layer.

4. A method of manufacturing a shaft for a golf club comprising the steps of:

cutting a prepreg sheet having a matrix resin and a fiber, thereby fabricating a full-length sheet provided wholly in an axial direction of the shaft and a partial sheet provided in a part in the axial direction of the shaft;

sticking sheets for bias layers together;

winding the cut sheet around a mandrel to obtain a wound body; and curing the matrix resin of the wound body to obtain a cured and laminated body, wherein the partial sheet includes a first tip bias sheet for orientating a fiber at an angle which is equal to or greater than −65 degrees and is equal to or smaller than −25 degrees with respect to an axis of the shaft and a second tip bias sheet for orienting a fiber at an angle which is equal to or greater than 25 degrees and is equal to or smaller than 65 degrees with respect to the axis of the shaft, the sticking step and/or the cutting step include(s) a step of obtaining a tip bias stuck body having the first tip bias sheet and the second tip bias sheet stuck together, the winding step includes a step of winding the tip bias stuck body, and when an end on a winding start side of the first tip bias sheet is represented by T1 and an end on a winding start side of the second tip bias sheet is represented by T2, an angle difference θ between a position in a circumferential direction of the end T1 and a position in the circumferential direction of the end T2 is equal to or smaller than 90 degrees.

5. The method according to claim 4, further comprising a step of polishing a surface of the cured and laminated body.

6. A method of making a shaft for a golf club, comprising the steps of:

winding and curing a prepreg sheet having a matrix resin and a fiber, the prepreg sheet including a full-length sheet provided wholly in an axial direction of the shaft and a partial sheet provided in a part in the axial direction of the shaft, wherein at least a part of the partial sheet forms a tip bias layer disposed in a tip portion of the shaft, the tip bias layer has a first tip bias layer and a second tip bias layer, a fiber of the first tip bias layer is oriented at an angle which is equal to or greater than −65 degrees and is equal to or smaller than −25 degrees with respect to an axis of the shaft, a fiber of the second tip bias layer is oriented at an angle which is equal to or greater than 25 degrees and is equal to or smaller than 65 degrees with respect to the axis of the shaft, there is wound a tip bias stuck body having a first tip bias sheet to be a sheet for the first tip bias layer and a second tip bias sheet to be a sheet for the second tip bias layer which are stuck together, and when an end on a winding start side of the first tip bias layer is represented by T1 and an end on a winding start side of the second tip bias layer is represented by T2, an angle difference θ between a position in a circumferential direction of the end T1 and a position in the circumferential direction of the end T2 is equal to or smaller than 90 degrees.

* * * * *